US005956986A

United States Patent [19]

Vonlanthen

[11] Patent Number: 5,956,986

[45] Date of Patent: Sep. 28, 1999

[54] LOCKING DEVICE WITH A CYLINDER LOCK AND A FLAT KEY

[75] Inventor: Benno Vonlanthen, Zollikofen, Switzerland

[73] Assignee: R. Berchtold A.G., Zollikofen, Switzerland

[21] Appl. No.: 09/091,059

[22] PCT Filed: Dec. 11, 1995

[86] PCT No.: PCT/CH95/00296

§ 371 Date: Jun. 9, 1998

§ 102(e) Date: Jun. 9, 1998

[87] PCT Pub. No.: WO97/21894

PCT Pub. Date: Jun. 19, 1997

[51] Int. Cl.[6] ..... E05B 27/00

[52] U.S. Cl. ..... 70/492; 70/495; 70/493

[58] Field of Search ..... 70/492, 493, 495, 70/358, 409, 494, 496

[56] References Cited

U.S. PATENT DOCUMENTS

| | | | |
|---|---|---|---|
| 2,039,126 | 4/1936 | Svoboda | 70/492 |
| 2,079,628 | 5/1937 | Olson | 70/492 |
| 2,375,682 | 5/1945 | Olson | 70/492 |
| 2,879,658 | 3/1959 | Johnstone | 70/495 |
| 3,035,433 | 5/1962 | Testa | 70/495 |
| 3,264,852 | 8/1966 | Gysin | 70/492 |
| 3,999,413 | 12/1976 | Raymond | 70/419 |
| 4,398,404 | 8/1983 | Wake | 70/276 |
| 4,750,342 | 6/1988 | Nakai | 70/364 R |
| 5,475,998 | 12/1995 | Raskevicius et al. | 70/495 |
| 5,582,050 | 12/1996 | Haggstrom | 70/495 |
| 5,709,115 | 1/1998 | Richter | 70/495 |
| 5,826,451 | 10/1998 | Cook | 70/495 |

OTHER PUBLICATIONS

International Preliminary Examination Report Translation for PCT/CH95/00296 issued for Jun. 1998.

*Primary Examiner*—Suzanne Dino Barrett
*Assistant Examiner*—Stephen Grady
*Attorney, Agent, or Firm*—Notaro & Michaelos P.C.

[57] ABSTRACT

On a cylinder lock (1) tumblers (10) are disposed which extend parallel to the broad side (8, 9) of the lock channel (6). The ends of these tumblers (10) block between the rotor (3) and the stator (4). On the rear side (17), facing away from the key channel (6), of the tumblers (10) are disposed additional codings. These codings cooperate with additional two-part blocking elements (20). These blocking elements (20) are displaceable at right angles to the lock axis and block in addition in the region of the shear line (32) between rotor (3) and stator (4). Therewith additional blocking combinations are possible and the security of the lock against unauthorized opening is increased.

8 Claims, 4 Drawing Sheets

LOCKING DEVICE WITH A CYLINDER LOCK AND A FLAT KEY

FIELD AND BACKGROUND OF THE INVENTION

The invention relates to a locking device with a cylinder lock and a flat key wherein the cylinder lock comprises a rotor rotatable in a stator with a key channel, and guides disposed approximately at right angles to the longitudinal axis of the rotor and parallel to the broad sides of the key channel which {guides} comprise tumblers provided with carriers projecting into the key channel, and the flat key comprises on the broad sides guide tracks which when the key is introduced into the key channel engage the carriers of the tumblers and at least in one portion of the tumblers on the rear side facing away from the key channel a hollow is disposed which cooperates with an additional blocking element.

Such a locking device with a cylinder lock and a flat key is known from U.S. Pat. No. 3,035,433. In the rotor of a cylinder lock is disposed a key channel which extends in the direction of the lock, respectively rotor, axis. This key channel serves for receiving a flat key. On the broad sides of the flat key are disposed guide tracks for positioning tumblers in the cylinder lock. These tumblers are supported in the lock in guides which are at right angles to the lock axis and extend parallel to the broad sides of the key channel. The tumblers comprise carriers which project into the key channel, respectively protrude into it and when the key is introduced into the key channel engage the guide tracks on the key. When the key is introduced completely into the key channel, and provided the guide tracks have the correct positioning planes for the carriers, the tumblers are completely in the rotor of the lock, and the rotor can be rotated in the stator. The lock comprises also an additional blocking element. This is disposed between the rear side of the tumblers and the stator and comprises a blocking bar which extends parallel to the lock axis and over all tumblers. This blocking bar is pressed by springs toward the outside into a groove with ramp surfaces in the stator. It is displaced from the groove in the stator by rotating the rotor and pushed against the rear side of the tumblers. In order for this displacement to be possible, into the rear side, facing away from the key channel, of the tumblers one groove each is worked which extends parallel to the blocking bar. The depth of this groove corresponds at least to the displacement path of the blocking bar during the rotation of the rotor. Otherwise, the rotor cannot be rotated and the lock cannot be opened.

Blocking bars of the known type form an additional element which secures the rotor in the stator against rotational movements. However, they do not form an additional security against unauthorized manipulations, for the example the so-called picking of the lock since the tumblers can be brought independently of the blocking bars into the opening positions. During the positioning process of the tumblers no cooperation exists between tumblers and blocking bar. Cooperation is only initiated if first the rotor can be rotated in the stator, i.e. if the tumblers are correctly positioned. As soon as the tumblers are in the correct opening position, however, the displacement path for the blocking bars is also released, since the groove on the rear side of the tumbler is also in the correct position.

SUMMARY OF THE INVENTION

The invention is based on the task of improving a locking device of the known type to the effect that the correct opening position of the tumblers is additionally encoded, and the additional coding is to be possible for each tumbler individually and for each tumbler a separate additional blocking element is to be available, and in the same lock tumblers without this additional coding or blocking can be also be disposed. Furthermore, the additional blocking element with the key pulled off is to maintain the particular tumbler in the blocked position and itself bring about an additional blocking between rotor and stator as well as permit the utilization of the peripheral dimensions of the tumblers.

This task is solved through the teaching provided in the invention. Advantageous further developments of the invention are evident based on the characteristics of the dependent patent claims.

The disposition of an additional two-part blocking element for at least a portion of the tumblers, and for each of the particular tumblers, yields the advantage that to each additional blocking element can be assigned a separate precisely definable opening position. Through the two-part implementation it is also possible to assign to each additional blocking element a shearing face which is implemented between the two blocking element parts and cooperates with the shearing face between rotor and stator. Each of the additional blocking elements is therein always in contact with the rear side of the tumblers on which several additional codings for blocking and opening positions of the additional blocking elements are implemented. This implementation of several different codings on the rear side of the tumblers has the advantage that the opening position of the lock is determined by two codings, namely, on the one hand, that on the key and, on the other hand, that on the rear side of the tumblers. A further advantage comprises that tumblers can also be used which engage the stator only in the peripheral region, i.e. in the outermost positions, in the remaining displacement region of the tumblers, however, would permit a rotation of the rotor. But in this displacement region the additional blocking element prevents the rotation of the rotor as long as there is no cooperation between the correct coding on the rear side of the tumbler with the additional blocking element.

Through the implementation of the codings on the positioning face on the rear side of the tumblers in the form of hollows or peaks, or a combination of hollows and peaks, a large number of blocking combinations can be generated. The peaks or the peripheral regions between two adjacent hollows opposite the blocking element part form tipping edges which permit the positioning only with the forced guidance of the tumbler. When attempting to displace the tumblers freely into an opening position, the end of the blocking elements in contact on the tumbler always presses the tumbler into a blocking position. Thereby the blocking elements is also not located in the opening position. This process is brought about through the tipping edges and the spring loading of the blocking elements acting in the direction of the tumblers. In further combination with planar faces which extend approximately parallel to the longitudinal axes of the tumblers, further coding advantages result.

By disposing a recess in the rear side of the tumbler and inserting a plate, advantageous two-part tumblers are obtained. The plate therein encompasses the positioning face for the additional blocking element with this positioning face being provided with the desired codings. Identically formed tumblers with identical dimensions can be equipped with different plates whereby the desired additional combination variants of blockings result. The plates are in known manner connected with the tumblers through a press fit, by adhesion or joining processes of similar type. The plates can also additionally be made uniform thereby that into the positioning face a row of bores with identical diameter is worked. These bores comprise in the exit region countersinks with identical or different dimensions; and into the bores are inserted, as necessary, additional pins with head pieces. The head pieces form therein elevations and/or planar faces.

These multiply new combinations capabilities of the tumblers according to the invention and additional blocking elements with the two independent coding capabilities a considerable increase of the possible blocking combinations result. Unauthorized interventions into the lock, respectively the opening of the lock without the correct key, are made considerably more difficult if not impossible. The forced intervention of the additional blocking elements into the codings on the rear side of the tumblers fixes these in the position into which they had been moved when the key was pulled from the lock. The lock can thereby be set in in any installation position without the danger that the tumblers do not assume the desired positions within the guides. They can also not be displaced from the blocking positions by vibrations. Moreover, it is also possible to combine only a portion of the tumblers available in a lock with additional blocking elements, which, nevertheless leads to an increase of the lock security and operational security.

BRIEF DESCRIPTION OF THE DRAWINGS

In the following the invention will be explained in further detail in conjunction with embodiment examples with reference to the enclosed drawings. Therein depict.

DESCRIPTION OF THE PREFERRED EMBODIMENT

Figure 1:
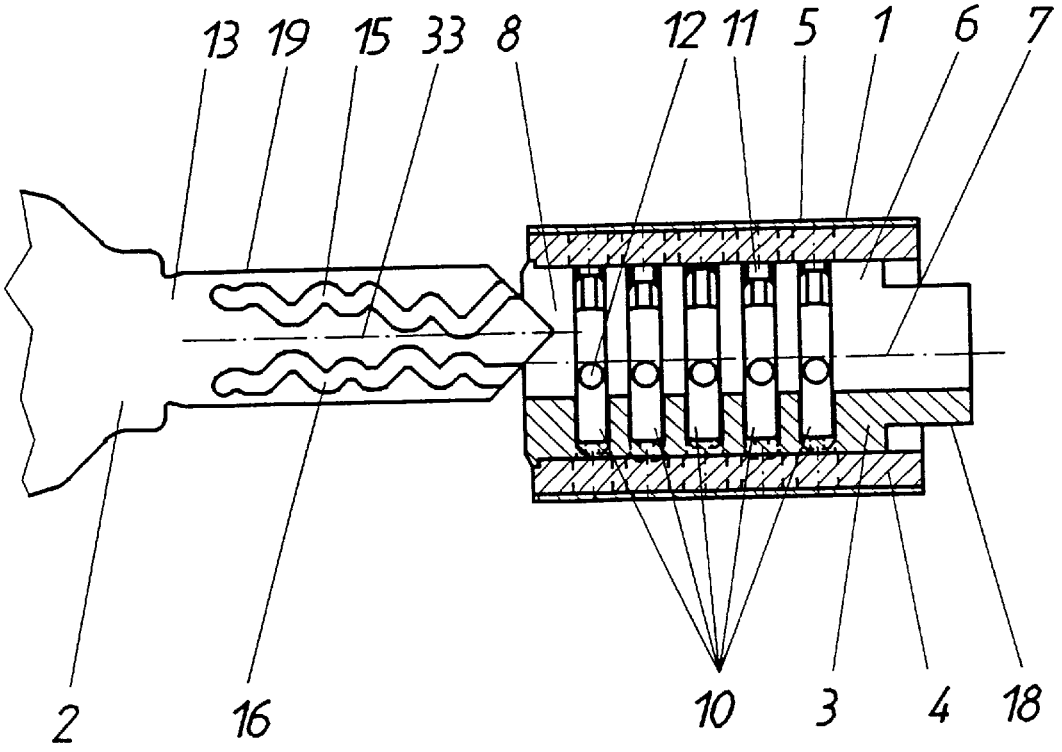
FIG. 1 a longitudinal section through a cylinder lock and the associated flat key in side view, FIG. 2 a cross section through a cylinder lock according to FIG. 1, and specifically at right angles to the longitudinal axis, and through a tumbler plane, FIG. 3 a perspective view of a two-part tumbler according to the invention with peaks and hollows in the positioning face, and FIG. 4 a cross section through a tumbler plane of a cylinder lock, with the tumblers comprising inset plates with bore rows.

The locking device depicted in FIG. 1 comprises a cylinder lock 1 and a flat key 2, in the example shown a flat turning key. The cylinder lock 1 is shown in simplified form and comprises a rotor 3 which is rotatable in a stator 4 and a sleeve 5 which encompasses the entire cylinder lock 1 as a jacket. Into the rotor 3 is worked a key channel 6 with a rectangular cross section. Into this key channel 6 can be introduced the key bit 19 of the key 2. Into the broad sides 13, 14 of the flat turning key 2 are milled guide tracks 15, 16 in the form of grooves, which serve for positioning the locking element in the cylinder lock 1. Since the key 2 is a turning key, on the not visible broad side 14 the groove 15 is disposed at the bottom and the groove 16 at the top. With respect to the center axis 33 of the key 2, thus identically formed grooves 15, respectively 16, are diagonally opposing each other on the two broad sides 13, 14. In the example depicted, on each broad side 8, 9 of the key channel 6 in the rotor 3 five tumblers 10 are disposed such that ten locking elements result. These tumblers 10 are supported in guides 11 of the rotor 3 and are displaceable transversely to the longitudinal axis 7 of lock 1. At the rear end 18 of the rotor 3 are available elements which are not shown but are known elements which cooperate with elements, also not shown, for example on a door latching.

Figure 2:
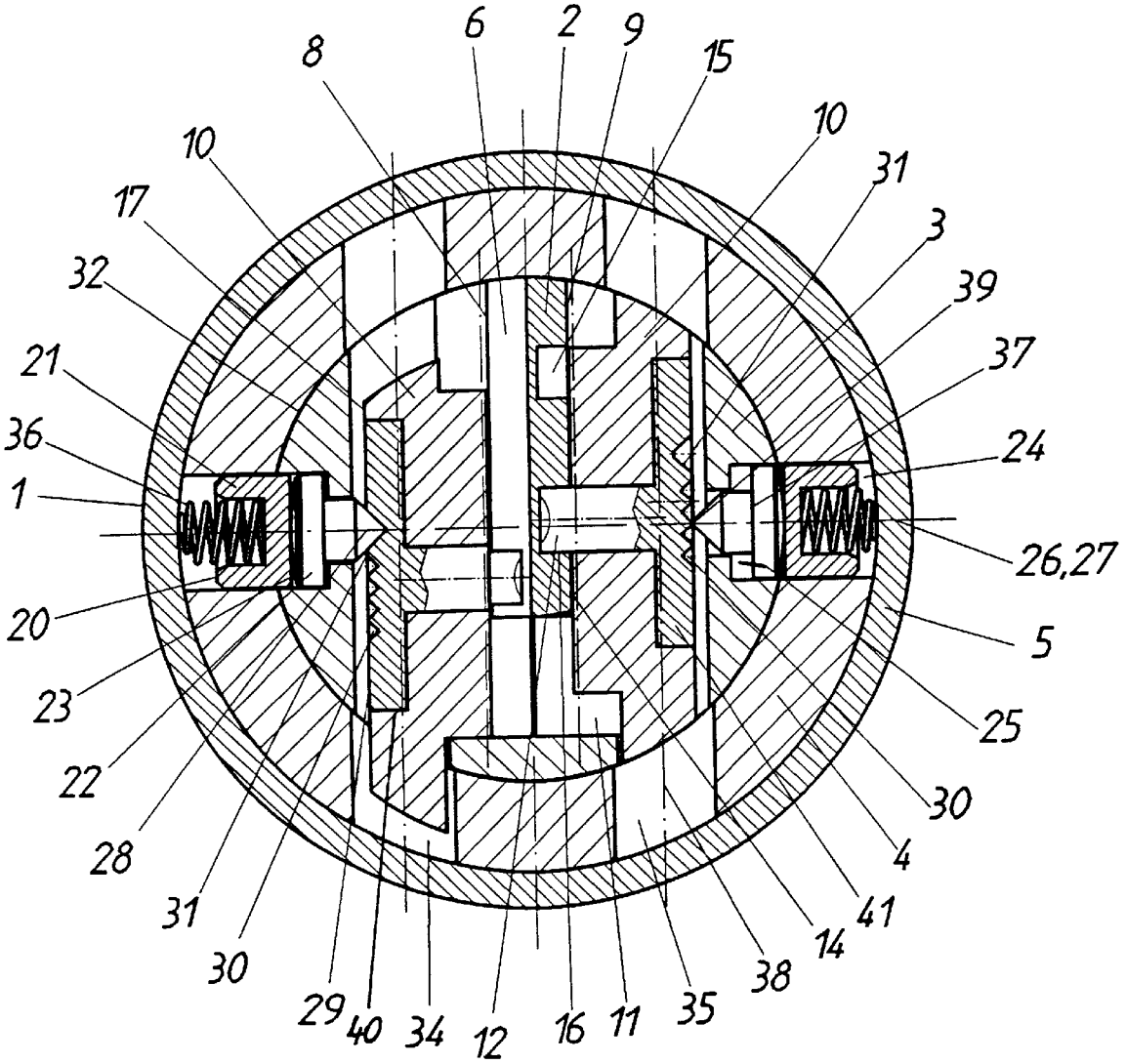

In FIG. 2 the disposition of the tumblers 10 in the cylinder lock 1 is shown. The tumblers 10 are placed in guides 11 in rotor 3. In that position of the rotor 3 in which the key 2 can be pulled out of the key channel 6, the guides 11 cooperate with bores 34, 35 in stator 4, and one end of the tumblers 10 engages these bores 34, respectively 35. In the position, shown in FIG. 2 in the left lock half, of the tumbler 10 in rotor 3 and stator 4, the lock 1 is blocked, i.e. the rotor 3 cannot be rotated relative to stator 4. The tumbler 10 is in this position when the key 2 is pulled off, which is the reason why no key is depicted in the left portion of the key channel 6. For actuating the tumblers 10 carriers 12 are disposed on these, which project into the key channel 6. If the key bit 19 depicted in FIG. 1 is inserted into the key channel 6, the carriers 12 engage the groove 16 and a corresponding groove 15 on the rear side, and the tumblers 10 are moved corresponding to the contour of grooves 15, 16. If the grooves 15, 16 are correctly encoded, then with the key 2 completely introduced all ten tumblers 10 are in the opening position, i.e. completely within within rotor 3. This position of the tumbler 10 is depicted in the right half of FIG. 2, which also shows key 2. The rotor 3 could thus be rotated in stator 4 if only the tumblers 10 were available as blocking elements.

In the embodiment according to the invention, between the tumblers 10 and the stator 4 are disposed additional blocking elements 20. These blocking elements 20 are in two parts and comprise a first part 21, which is supported in a bore 24 in the stator 4, and a second part 22, which is supported in a bore 25 in the rotor 3. In the blocking position shown of lock 1, respectively in the position of rotor 3 in stator 4 in which the key 2 can be pulled off, the axes 26 and 27 of the two bores 24 and 25 coincide. In this position the two bores 24 and 25 form a common guide bore in which the blocking element parts 21 and 22 can be moved back and forth between stator 4 and rotor 3. The first blocking element part 21 is implemented in the form of a pot and is pushed by a compression spring 36 in the direction of the tumbler 10. The second blocking element part 22 comprises a shoulder 37 which cooperates with the offset of the step bore 25. Between the two blocking element parts 21 and 22 a dividing face 23 is formed along which the two parts 21 and 22 can be moved relative to one another. The offset end 28 of the second blocking element part 22 rests in contact on the rear side 17 of the tumblers 10. As rear side 17 of the tumblers 10 that side of the tumblers 10 is denoted which faces away from the key channel 6. This rear side 17 is equipped with a positioning face 29 into which the codings are worked in the form of hollows 30, 31. The end 28 is formed corresponding to the slope forms of the hollows 30, 31 and in the example depicted tapers into a peak. If the tumblers 10 are displaced in the direction of their longitudinal axes 38, respectively parallel to the broad sides 8, 9 of the lock channel 6, the end 28 of the second blocking element part 22 in each instance snaps into the hollows 30, 31. The outermost hollow 31 in the positioning face 29 of the tumbler 10 is therein implemented to be especially deep. It maintains the tumbler 10 after the key 2 is pulled from lock 1 in the blocking position in which one end of the tumbler 10 engages the bore 34 of stator 4. In addition the blocking element 20 also blocks in bore 24 since the first blocking element part 21 is displaced beyond the shear line 32 between rotor 4 and stator 3. The tumbler 10 shown in FIG.

2 in the right half is depicted in the opening position, i.e. it does not engage with either of the two ends the bore 35 on stator 4. The tumbler 10 is held in this position by key 2 thereby that the carrier 12 is held and positioned by the guide track 16. The end 28 of the second blocking element part 22 rests therein on an edge 39 between two hollows 30 serving as tipping edge. The dividing face 23 between the two blocking element parts 21 and 22 is therein disposed on the shear line 32 between rotor 3 and stator 4. If all blocking elements 20 of lock 1 are in this position and no tumbler 10 engages a bore 34, 35 of the stator 4, the rotor 3 can be rotated. Attempts to position and hold the tumblers 10 with foreign means and without the correct key 2 in this opening position, fail since the end 28 of the blocking element part 22 snaps immediately into one of the two hollows on both sides of the tipping edge 39 and displaces the tumblers 10 into a blocking position. In the blocking position one end of tumblers 10 again engages the bore 35 on stator 4. In addition, the two blocking element parts 21, 22 are displaced against the tumbler 10 whereby the dividing face 23 no longer coincides with the shear line 32, and the first blocking element 21 blocks the rotor 3.

The tumblers 10 in FIG. 2 are implemented in two parts. On the rear side 17 is disposed a recess 40 into which a plate 41 is placed. The connection between plate 41 and tumbler 10 is brought about through a press fit, an adhesion connection or another known suitable connecting technique. In the example according to FIG. 2 the plate 41 is integrally connected with the carrier 12 and pressed as a whole into the corresponding recess 40 of the tumblers 10. This embodiment has the advantage that the tumblers 10 can be prefabricated in the desired standard dimensions. The implementation of the desired coding on the rear side 17 of the tumbler 10 takes place through the assembly with a correspondingly implemented plate 41. Therein it is also simultaneously possible to vary the diameter of the carrier 12. A further advantage comprises that the tumblers 10 themselves, as is known, can be manufactured for example of nonferrous heavy metal, for the plate 41 with carrier 12, however, a hard material or hardened steel can be used. This increases significantly the abrasion resistance and service life of the lock 1.

Figure 3:
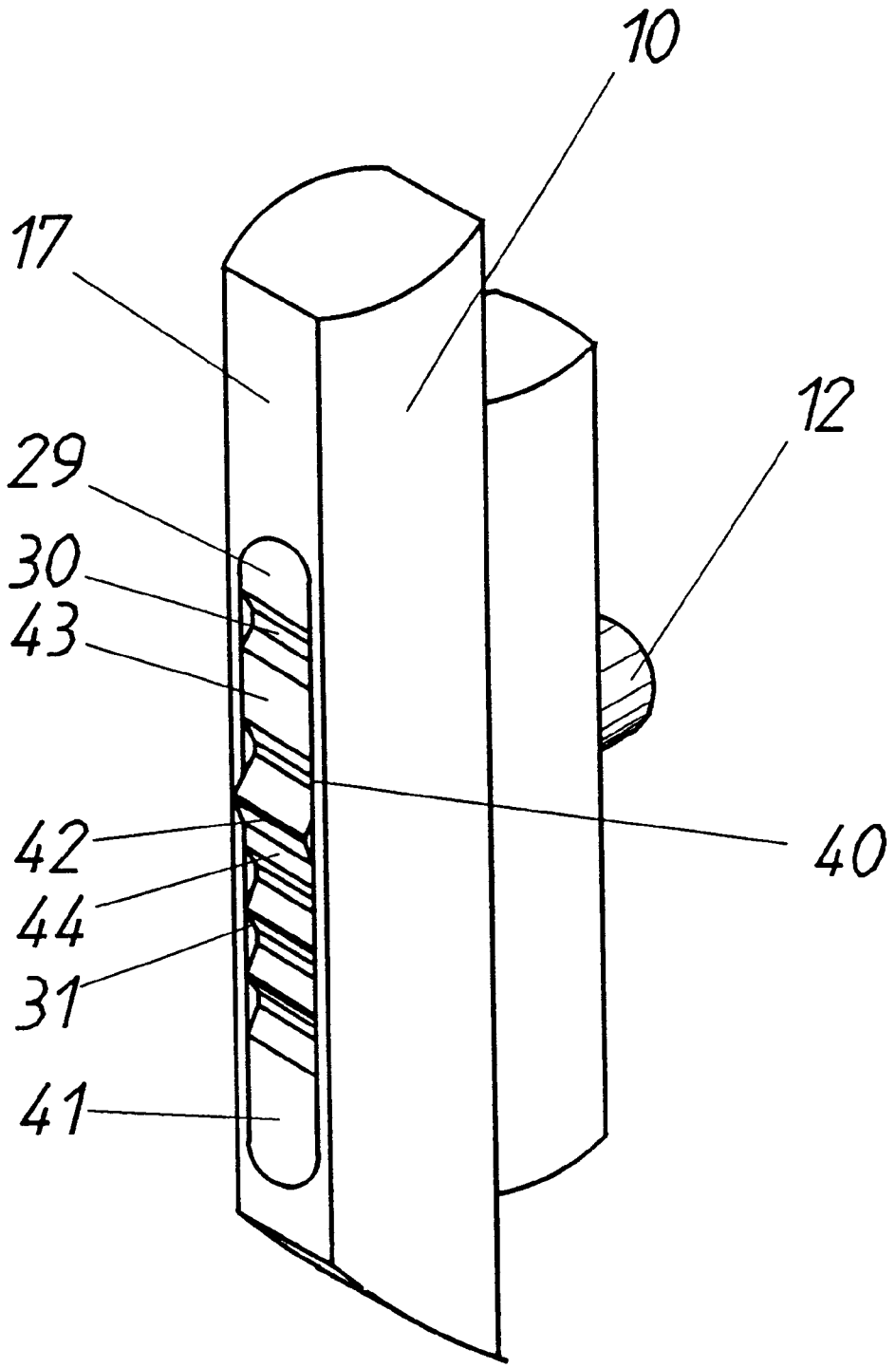

FIG. 3 shows a two-part tumbler 10 in enlarged perspective view. In actuality the tumblers 10 are only a few millimeters long. The plate 41 which is set into the recess 40, comprises on the positioning face 29 hollows 30 and 31 and peaks 42, with the latter projecting beyond the face 29. Between the hollows 30, 31 and/or peaks 42 planar faces 43, 44 are also present which extend approximately parallel to the longitudinal axis 38 or the tumbler 10. The correct opening position for the additional blocking element 20 can be predetermined or coded on a peak 42, in a hollow 30, 31, on a planar face 43, 44, or in an intermediate position, for example on an oblique slope. This multiplicity of additional coding feasibilities for the additional blocking element 20 increase significantly the blocking variants for a correspondingly implemented lock 1. It is also apparent that the unauthorized opening of the lock, for example by picking, is made virtually impossible since the correct position of the additional blocking elements 20 and the correct position of the tumblers 10 with respect to one another is superimposed and the opening combinations are not detectable. The additional blocking elements 20 in the blocking position block the rotor 3 effectively and free of play against rotary movements in the stator 4. This permits, if necessary, also the use of tumblers 10 which in the blocking position engage the bores 34, 35 in the stator 4 only minimally, i.e. have peripheral dimensions. Since the blocking elements 20 block effectively, the ends of the tumblers 10 with peripheral dimensions can also not be deformed or damaged even when force is exerted onto the rotor 3.

Figure 4:
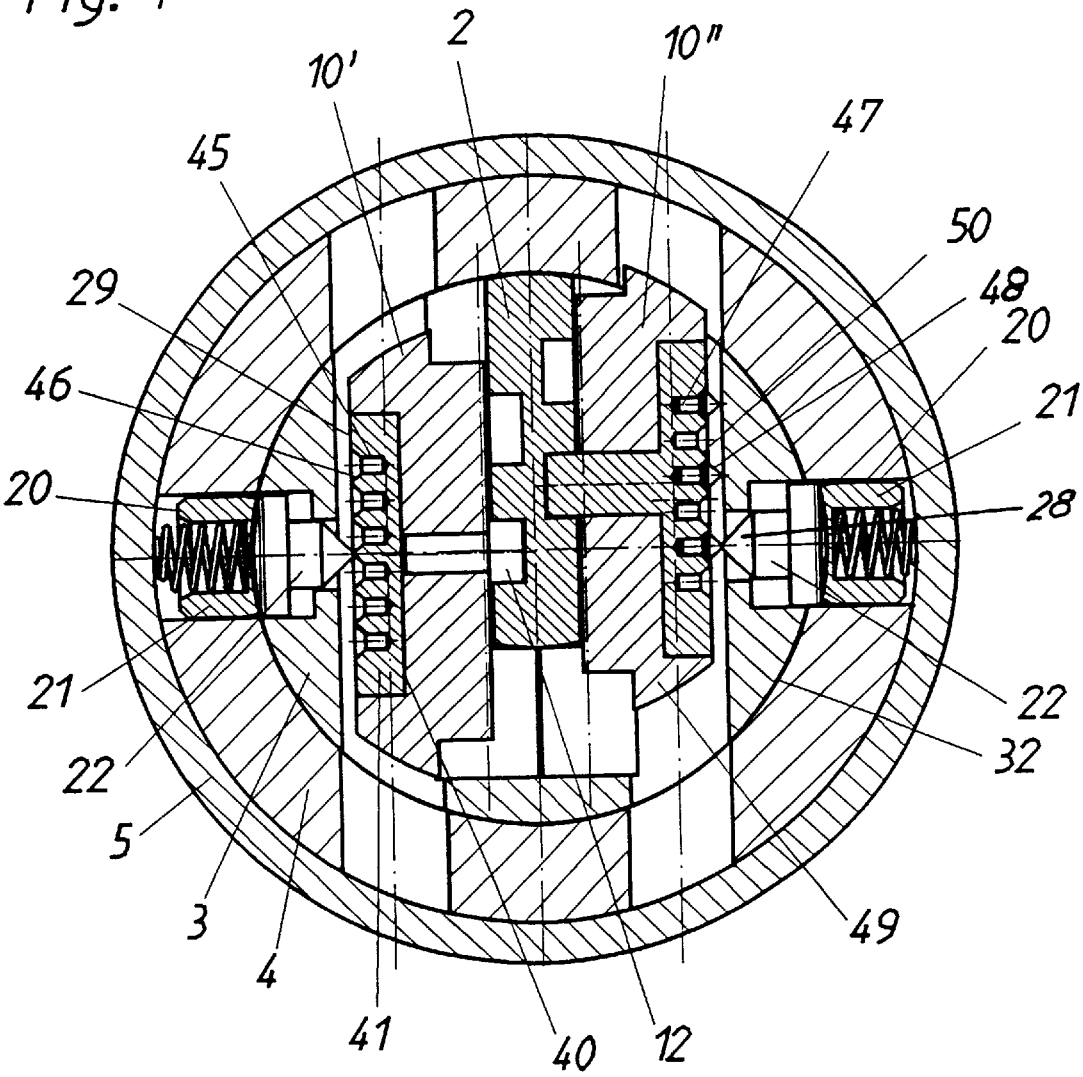

In the cross section depicted in FIG. 4 through a lock 1 tumblers 10' and 10" are shown which are equipped with a further embodiment of the plate 41. In it, into the positioning face 29 on plate 41 a row of bores 45 are worked which form the coding for the end 28 of the second blocking element part 22. In addition, the bores 45 are provided with countersinks 46. On the right side of FIG. 4 an additional modification of this plate 41 with bores 45 is depicted wherein at least into a portion of the bores 45 pins 47 with head pieces 48 are set. These head pieces form peaks with tipping edges, but can also comprise end faces. This embodiment permits the adaptation or change of codings on the rear side 17 of the tumblers 10', respectively 10" in a particularly simple manner since the desired tumblers can be assembled from prefabricated single parts and as needed. In the left half of FIG. 4 is also evident that the carrier 12 can be set into the tumblers 10' as a separate part. For the remainder, the lock 1 depicted in FIG. 4 with key 2 has all of the characteristics as were already described in connection with FIG. 2.

In the embodiment of the lock according to FIG. 2 as well as also according to FIG. 4, in addition to the tumblers 10, 10' or 10" shown, tumblers with positioning faces 29, respectively codings, implemented differently, for the additional blocking element 20 can also be used. In the lock according to FIG. 4, for example, one or several tumblers according to FIG. 3 can be used. In each case, the advantages result that the opening positions of the tumblers 10, 10' or 10" are additionally encoded, and the additional coding for each tumbler 10, 10' or 10" takes place individually and can be changed individually. Each additionally coded tumbler 10, 10' or 10" comprises a separate additional blocking element 20. This blocking element 20 maintains the tumbler 10, 10' or 10" when the key 2 is pulled off in the blocking position and blocks the rotor 3, in turn, itself additionally against rotary movements in the stator. The installation of a lock 1 implemented according to the invention is possible in any position since the tumblers 10, 10' or 10" are positioned into the terminal positions and held through the blocking elements 20 and cannot assume independently any undesired positions along the guides 11 in rotor 3 or stator 4. The additional blocking elements 20 can block positively or negatively between rotor 3 and stator 4. If the dividing face 23 is located between the first part 21 and the second part 22 of the blocking element 20 in the region of stator 4, and thus outside of the circle of the shear line 32 the blocking is referred to as positive. The second part 22 of the blocking element 20 projects into stator 4. In the case of negative blocking, the first part 21 projects into rotor 3, and the dividing face 23 is disposed within the circle of the shear line 32 between rotor 3 and stator 4.

Tumbler 10" in the right half of FIG. 4 illustrates a further advantages of the invention. In locking systems with many different locks and keys, tumblers 10" must to some extent be used whose end portion 49 is too short in order to be able to engage stator 4 in the end position. With the key pulled off, such tumblers 10" cannot assume any blocking function. By means of the two-part blocking element 20 this blocking function, however, is again obtained. When pulling off the key 2 from lock 1 the tumbler 10" is guided last completely downwardly, and the second blocking element part 22 snaps into the outermost hollow 50. Thereby the first blocking element part 21 is displaced beyond the shear line 32 toward the inside, and the rotor 3 is blocked against displacement in stator 4. Thus a considerable improvement of the lock security is attained. A further advantage comprises that in closing systems with a relatively large number of differently coded locks individual locks can be equipped selectively with additional codings concerning the blocking elements 20. This permits also when using tumbler 10" with short end portions 49 the additional expansion of the blocking combinations and thus an improvement of the security.

I claim:

1. A locking device having a cylinder lock and a flat key, wherein the cylinder lock comprises a rotor rotatable in a stator with a key channel having a pair of channel broad sides, the rotor further having guides with at least two tumblers approximately at right angles to a longitudinal axis of the rotor and parallel to the pair of channel broad sides, each of the at least two tumblers being provided with a carrier arranged to project into the key channel and the flat key comprises a pair of key broad sides having guide tracks, such that when the flat key is inserted into the key channel, the guide tracks engage the at least two carriers, the locking device comprising:

a rear side of each tumbler facing away from the key channel;

a positioning faces on each tumbler rear side, each positioning face having at least two codings, one of the codings being an unlock coding;

a number of second blocking elements corresponding to the number of tumblers, each second blocking element disposed between the stator and the rear side of one of the tumblers, each second blocking element comprising:

a first part movably supported in a bore in the stator;

a second part movably supported in a bore in the rotor, aligned on a blocking element longitudinal axis with the first part and having a dividing face in slidable contact with an end face of the first part;

a blocking element end of the second part contacting the codings on the adjacent positioning face;

such that when the blocking element end of each second blocking element is positioned contacting the unlock coding on the positioning face of the corresponding tumbler, the dividing face and end face of each second blocking element coincide with a shear line between the stator and rotor permitting rotation of the rotor.

2. A locking device according to claim 1, wherein the codings comprise grooves, ridges or a combination thereof.

3. A locking device according to claim 1, further comprising a recess formed in the rear side of each tumbler, and at least two plates, each plate having one of the positioning faces and one plate held within each recess.

4. A locking device according to claim 1, further comprising at least one planar face on the positioning faces between the at least two codings, the at least one planar face oriented extending parallel to a tumbler longitudinal axis.

5. A locking device according to claim 1, wherein the at least two codings are a pair of grooves in the positioning face, and adjacent walls of the grooves are arranged with an intersection of the adjacent walls forming a tipping edge for the blocking element end.

6. A locking device according to claim 1, wherein the at least two codings on each positioning face comprise at least two bores formed in the positioning face.

7. A locking device according to claim 1, wherein the at least two codings on each positioning face comprises a plurality of bores formed in the positioning face, at least two pins having head pieces oriented with the head pieces forming peaks or planar faces on the positioning face.

8. A locking device according to claim 1, wherein each second blocking element further comprises a pressure spring positioned between the rotor and the first part biasing the first and second parts toward the corresponding tumbler.

* * * * *